US007586050B2

(12) United States Patent
Lashua

(10) Patent No.: US 7,586,050 B2
(45) **Date of Patent: *Sep. 8, 2009**

(54) ERGONOMIC SNOW PLOW CONTROL SYSTEM

(76) Inventor: John A. Lashua, P.O. Box 112, Iola, WI (US) 54945

( * ) Notice: Subject to any disclaimer, the term of this patent is extended or adjusted under 35 U.S.C. 154(b) by 686 days.

This patent is subject to a terminal disclaimer.

(21) Appl. No.: 10/956,539

(22) Filed: Oct. 1, 2004

(65) Prior Publication Data

US 2005/0039968 A1 Feb. 24, 2005

Related U.S. Application Data

(63) Continuation-in-part of application No. 10/236,374, filed on Sep. 6, 2002, now Pat. No. 6,852,934.

(60) Provisional application No. 60/318,242, filed on Sep. 7, 2001.

(51) Int. Cl.
*H01H 9/00* (2006.01)

(52) U.S. Cl. ..... 200/5 R; 200/5 A

(58) Field of Classification Search ..... 200/5 A, 200/5 R, 329.61, 54, 61.55, 61.56, 61.57, 200/61.27, 61.28; 37/231, 234–236
See application file for complete search history.

(56) References Cited

U.S. PATENT DOCUMENTS

| | | | | |
|---|---|---|---|---|
| 2,863,015 A | | 12/1958 | Ahrens | |
| 4,447,860 A | | 5/1984 | Stone et al. | |
| 4,776,750 A | | 10/1988 | Griswold, Jr. et al. | |
| 4,831,752 A | | 5/1989 | Clevenger | |
| 5,305,181 A | * | 4/1994 | Schultz | 361/680 |
| 5,361,519 A | * | 11/1994 | Ciula et al. | 37/234 |
| 5,461,936 A | * | 10/1995 | Bulkeley | 74/489 |
| 5,524,368 A | * | 6/1996 | Struck et al. | 37/235 |
| 5,707,262 A | | 1/1998 | Huntley et al. | |
| 5,790,065 A | | 8/1998 | Yaroch | |

(Continued)

FOREIGN PATENT DOCUMENTS

WO WO/00/50264 A1 8/2000

(Continued)

OTHER PUBLICATIONS

Lashua, U.S. Appl. No. 60/318,242, filed Sep. 7, 2001 A.D.

(Continued)

*Primary Examiner*—Elvin G Enad
*Assistant Examiner*—Marina Fishman
(74) *Attorney, Agent, or Firm*—Christopher John Rudy

(57) ABSTRACT

A housing can be mounted to a component in a cab of a vehicle; and a switch pad can have control keys, the pad mounted in the housing such that the keys are readily accessible to an operator of the vehicle during plowing operation such as shifting and/or steering. A securing member, which may be in a form of a strap system, may be attached to the housing away from the pad and keys for mounting the housing to the cab component. The housing may have a channel or a cannulation for mounting to the cab component. The housing may be resilient, making for increased comfort especially in long-term operation. The housing and pad assembly may be compact for storage in a glove box of the vehicle. Also, the control system can be wireless and remote.

16 Claims, 3 Drawing Sheets

U.S. PATENT DOCUMENTS

| | | | | |
|---|---|---|---|---|
| 5,894,688 | A | 4/1999 | Struck et al. | |
| 6,044,153 | A * | 3/2000 | Kaschke | 379/433.01 |
| 6,078,252 | A | 6/2000 | Kulczycki et al. | |
| 6,163,985 | A | 12/2000 | Chinnery et al. | |
| 6,165,129 | A * | 12/2000 | Bates | 600/481 |
| 6,363,629 | B1 | 4/2002 | Curtis | |
| 6,467,199 | B1 | 10/2002 | Christy | |
| 6,491,319 | B2 * | 12/2002 | Bonn | 200/511 |
| 6,852,934 | B1 * | 2/2005 | Lashua | 200/5 R |

FOREIGN PATENT DOCUMENTS

WO WO 0050264 A1 * 8/2000

OTHER PUBLICATIONS

Lashua, U.S. Appl. No. 10/236,374 filed Sep. 6, 2002 A.D.
Esterline Elastomeric Keypads, 2004, Interface Technologies Group, Memtron Input Components, pp. 1-2.
Feb. 18, 2009 Office action in U.S. Appl. No. 11/378,186 for Ergonomic Plow Control System.

* cited by examiner

ERGONOMIC SNOW PLOW CONTROL SYSTEM

CROSS-REFERENCE CLAIMS OF PRIORITY

This claims benefit under 35 USC 120 as a continuation-in-part of U.S. utility patent application Ser. No. 10/236,374 filed on Sep. 6, 2002, A.D., which issued as U.S. Pat. No. 6,852,934 B1, which, as well as does the present matter, claims benefit under 35 USC 119(e) of U.S. provisional patent application No. 60/318,242 filed on Sep. 7, 2001 A.D. The specifications of both of those applications are incorporated herein by reference in their entireties.

FIELD OF THE INVENTION

The present invention concerns a plow control system. In particular, it concerns a snow plow control system for a vehicle.

BACKGROUND TO THE INVENTION

The task of plowing snow from large parking lots with a plowing vehicle can be long in duration, demanding of attention and response, and tiresome for the operator. With known snow plow control devices, it is difficult at best to control the vehicle transmission shifter and the snow plow simultaneously.

Joy stick or electric toggle switch type controls and even hand held remote control units are known but are problematic as most of the control operation is done at the same time as the operator would shift from either forward to reverse or from reverse to forward. With such known devices the operator shifts into forward, then reaches for the control stick, which is often mounted on the dashboard or floor tunnel. When the plow or other attachment goes down, then the operator can start forward motion of the vehicle with plow. When the vehicle arrives at the end of its forward motion, the operator stops the vehicle, reaches for the control and then operates it to pick up the plow or other attachment, then shifts into reverse to start backward motion.

Newer hand-held controls help the operator shift and control the plow or other attachment simultaneously by permitting the operator to hold the control with the fingers of the hand with which he handles the shift-knob by his palm, but the controls are fairly big and clumsy, making the job very uncomfortable and fatiguing after only a few hours of operation. Also, the cord with which this type of control is supplied with often gets in the way of the dash controls, cell phones, beverage holders, etc.

Various patent art is known, some attempting to address needs of the snow plow operator, other advancing other arts or needs. Among such art are the following U.S. patents:

U.S. Pat. No. 2,863,015 to Ahrens. This discloses a steering wheel for motor vehicles having a spoke for mounting thereon the electric switches for operating the electrical equipment of the vehicle. Although it is an object to mount the switches on the spoke so that the driver need not take his hands off the wheel when operating the switches, practically speaking, unless the rim of the wheel is small, at least one of the driver's hands generally must be removed from the rim of the wheel to reach and operate the switches, especially those nearer the hub of the wheel. A series of toggle switches, dials and buttons are provided for operating the horn, lights, heater, turn indicator, windshield wiper, or hydraulic steering implements.

U.S. Pat. No. 4,776,750 to Griswold, Jr. et al. This discloses a remote control system for an earth working vehicle. Levers comprise the controls in the cab, and duplicate, miniature levers may comprise the controls at a radio controlled remote location.

U.S. Pat. No. 4,831,752 to Clevenger. This discloses a mounting arrangement for snowplow blade control switches. The arrangement is mounted by a bracket to the gearshift lever of a plow vehicle so that the switches are to be accessible to the operator. The switches, however, are standard toggle switches for controlling only a simple blade, and these are mounted to a hard bracket and connected by a wire. Reaching and operating the switches can be more difficult in practice than desired.

U.S. Pat. No. 5,361,519 to Ciula et al. This discloses a control pad for a snowplow. A simple pushbutton pad is mounted to a housing mounted to the dashboard of the vehicle or is placed on the lap of the operator. Wire connections are made to the plow.

U.S. Pat. No. 5,524,368 to Struck et al. This discloses a wireless snow plow control system, with toggle switches and radio control.

U.S. Pat. No. 5,707,262 to Huntley et al. This discloses a wireless trim control system for a boat drive.

U.S. Pat. No. 5,790,065 to Yaroch. This discloses a remote control for vehicular audio systems.

U.S. Pat. No. 6,078,252 to Kulczycki et al. This discloses a vehicle wireless switching system. In this invention, otherwise known switches or sensors previously known to have been wire-connected, are activated by a remote transmitter and a receiver.

U.S. Pat. No. 6,193,985 to Chinnery et al. This discloses a system for controlling a snowplow and other vehicle accessories. Digital control through a wire connection to a switch-pad is employed.

Note, too, the following various art:

U.S. Pat. No. 4,447,860 to Stone et al. for a backlighted instrument console for a tractor.

U.S. Pat. No. 5,461,936 to Bulkeley for a motorcycle control lever connector.

U.S. Pat. No. 5,894,688 to Struck et al. for a power assisted snowplow support stand.

U.S. Pat. No. 6,363,629 to Curtis for a vehicle hitch mount assembly for a snow plow.

U.S. Pat. No. 6,467,199 to Christy for a hand-control for V-plows.

U.S. Pat. No. 6,491,319 to Bonn for a steering wheel assembly and a switching device thereof. Compare, WO 2000/50264.

Note further the following U.S. patents:

U.S. Pat. No. 5,305,181 to Schultz for an arm or wrist mounted terminal with a flexible housing.

U.S. Pat. No. 6,044,153 to Kaschke for a hand adaptive telephone.

U.S. Pat. No. 6,165,129 to Bates for a removable mountable pulse rate monitoring system.

SUMMARY OF THE INVENTION

The present invention provides an ergonomic plow control system comprising a housing capable of being mounted to a component in a cab of a vehicle; a switch pad having control keys, said pad mounted in the housing such that said keys are readily accessible to an operator of the vehicle during plowing operation such as shifting and/or steering; and, optionally, a securing member attached to the housing away from said pad and keys for mounting the housing to said component.

The switch pad may comprise an arrangement for control of a straight plow and/or of a V-plow having a central element divided into a plurality of independently actuatable switches as for controlling orientation of a plow; at least one laterally disposed switch set for controlling vertical adjustment of the plow; and, optionally, another switch set as for controlling "on-off" of the plow. The system may be embodied in a housing, which may be flexible, which may have an attached mounting strap system.

The invention is useful in plowing, especially of snow.

Significantly, by the invention, a control system is provided which is adaptable to many areas and in many situations in the cab of plowing vehicles of numerous if not all brands and models. It particularly can be positioned so that the operator can have at his ready command, and without excessive movement of or strain on his hand, both the control system and another part of the vehicle's intrinsic controls such as the steering wheel or gearshift lever. The system may include an especially effective switch pad arrangement, making for ease of operation, and an optional resilient housing, making for surprisingly increased comfort especially in long-term operation. Also, in typical, preferred embodiments, the control system is wireless and remote. When embodied with the attached strap mounting system, additional versatility, compactness, and utility can be provided.

Numerous further advantages attend the invention.

THE DRAWINGS IN BRIEF

The drawings form part of the specification hereof. With respect to the drawings, which are not necessarily drawn to scale, the following is briefly noted:

ILLUSTRATIVE DETAIL OF THE INVENTION

The invention can be further understood by the present detail, which may be read in view of the drawings. Such is to be taken in an illustrative and not necessarily limiting sense.

In general, the plow control system of the invention is ergonomic in layout, mounting and operation. Preferably, the system is detachable. The system includes a housing capable of being mounted to a component in a cab of a vehicle such as the rim of a steering wheel, a gearshift lever, or possibly a dashboard. Nonetheless, the system may be hand held or mounted elsewhere, say, to the wrist of the operator. Preferably, the housing is resilient, say, being made of a flexible solid or foamed plastic. A switch pad is in the housing, which has control keys that are readily accessible to an operator of the vehicle during plowing operation such as shifting and/or steering. The switch pad may have a central element divided into a plurality of independently actuatable switches as for controlling orientation of a straight plow and/or a V-plow, and at least one laterally disposed switch set for controlling vertical adjustment of the plow. Another switch set for controlling "on-off" of the plow may be provided. A securing member for the system may be attached to the housing away from the switch pad and keys for mounting the housing to the vehicle component of interest. The system can be wire-connected or wireless, but preferably is wireless. The system is remote, i.e., the control is positioned at a location, e.g., in the cab of a plowing vehicle, distant from the location of the plow, which is outside the vehicle. The plow control system may be embodied in a housing, which may have an attached mounting strap system, which housing may be thin and/or flexible and can contain a suitably flexible, if need be or desired, key pad. Strap(s) for the strap mounting system are beneficially flexible, and can contain fastening contrivance(s) to assist in mounting. The strap(s) may have enough weight and flexibility to lie flat when not connected, advantageous, say, to rest a unit on a dashboard.

Figure 1A:
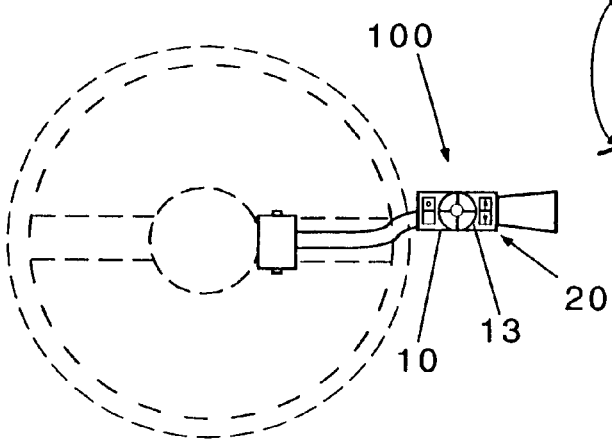
FIG. 1A is a plan view of an ergonomic plow control system of the invention, attached to a column gear shift lever of a plowing vehicle, for control of a V-plow.
Figure 2B:
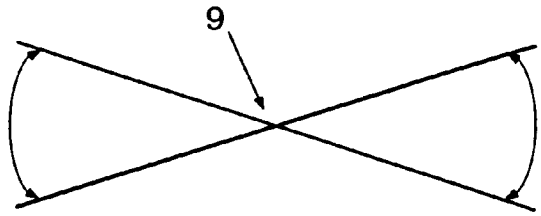
FIG. 2B is a top plan view of the straight plow.
Figure 1B:
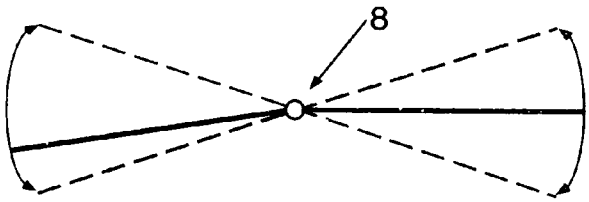
FIG. 1B is a top plan view of the V-plow.
Figure 3:
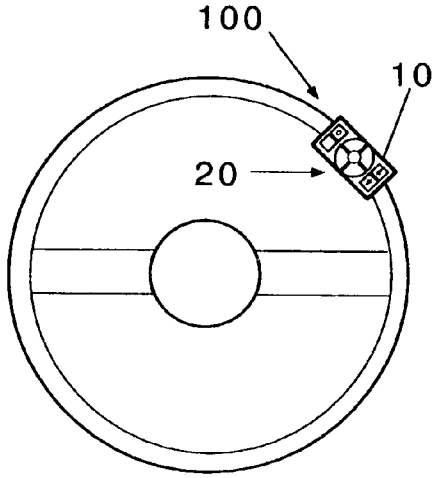
FIG. 3 is a plan view of the system of FIG. 1 attached to the rim of a steering wheel of the plowing vehicle.
Figure 2A:
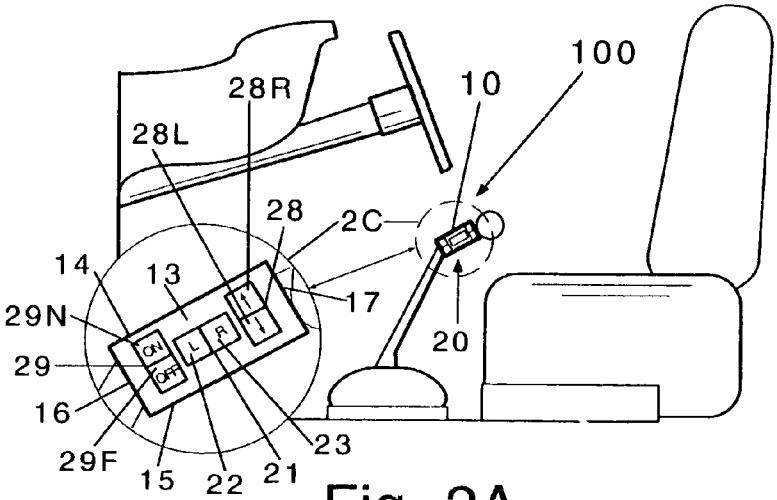
FIG. 2A is a plan view of another embodiment of the invention, attached to the floor gear shift lever of a plowing vehicle for control of a straight plow, with detail in circle 2C.
Figure 4:
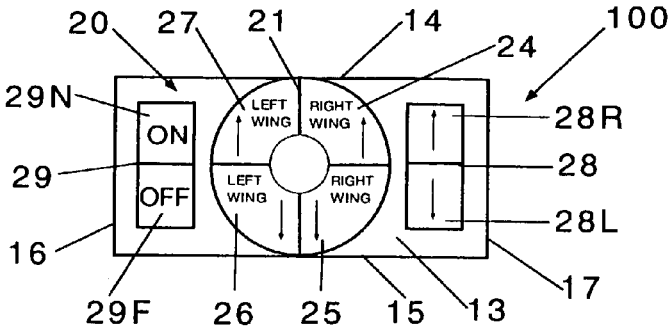
FIG. 4 is a detailed view of the control system employed in the systems of FIGS. 1A and 3.
Figure 5:
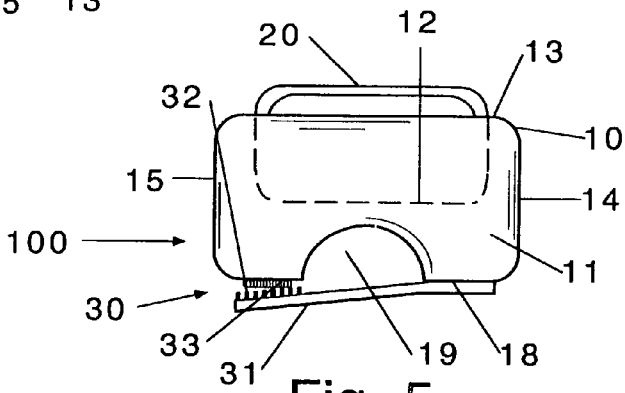
FIG. 5 is a side view of the system of FIG. 4.
Figure 6:
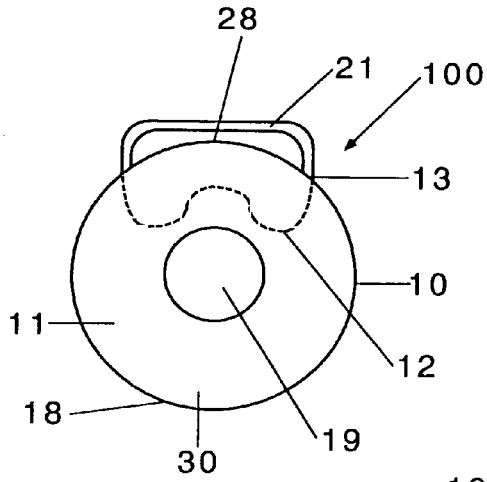
FIG. 6 is a side view of another embodiment of the invention.
Figure 7:
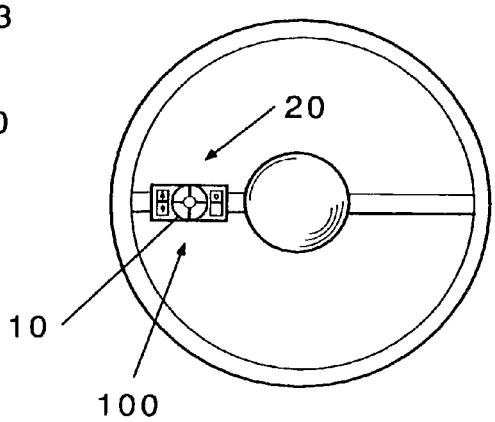
FIG. 7 is a plan view of the system of FIG. 1 attached to the spoke of a steering wheel of the plowing vehicle.
Figure 8:
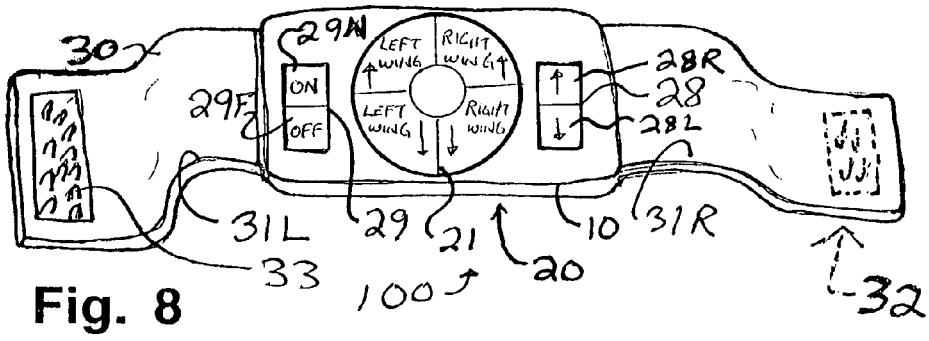
FIG. 8 is a top view of another ergonomic plow control system of the invention embodied with an attached strap mounting system.
Figure 9:
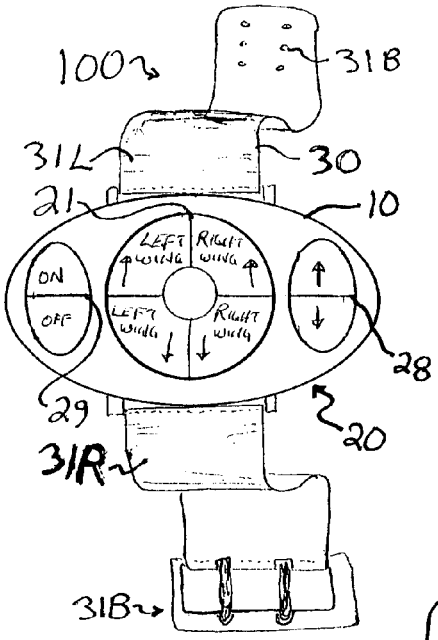
FIG. 9 is a top view of another ergonomic plow control system of the invention embodied with an attached strap mounting system.
Figure 10:
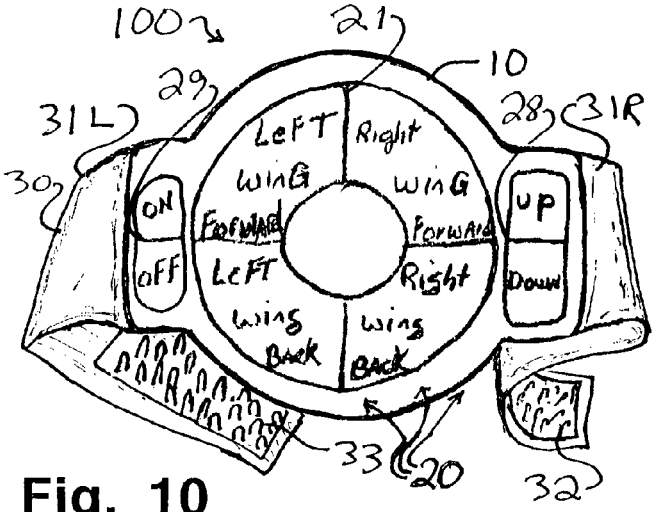
FIG. 10 is a top view of another ergonomic plow control system hereof, embodied, as in FIGS. 8 and 9, with a two-strap attached strap mounting system, but also with a flexible housing.
Figure 11:
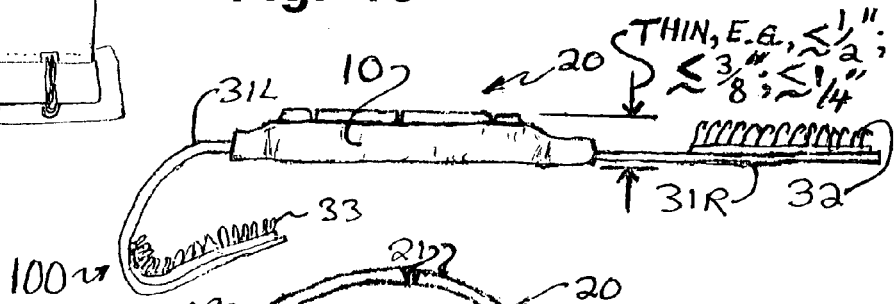
FIG. 11 is a side view of the embodiment of FIG. 10.
Figure 13:
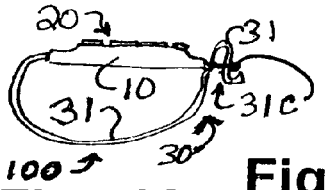
FIG. 13 is a side view of yet another ergonomic plow control system hereof with a one-strap, attached strap mounting system.
Figure 12:
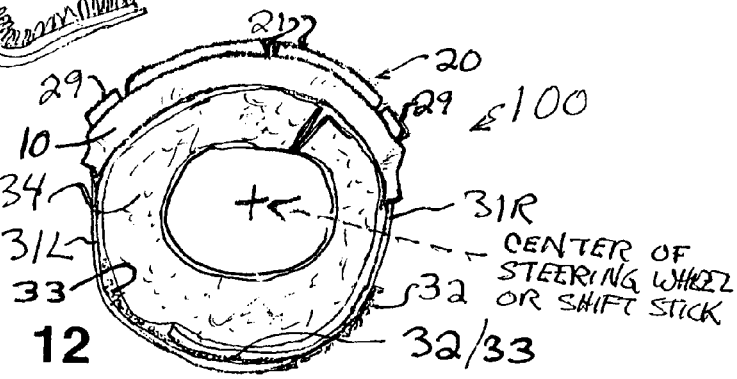
FIG. 12 is a side view of the embodiment of FIG. 10, mounted through employment of the strap mounting system.

With respect to the drawings, V-plow 8 or straight plow 9 is controlled by remote plow control system 100. The system 100 can include resilient foamed closed cell plastic housing 10 having interior 11 with cavity 12, face 13, first and second opposing sides 14, 15, and third and fourth opposing sides 16, 17 normal to the sides 13, 14. Of course, other shapes, say, circular, elliptical, triangular, pentagonal, irregular polygonal or curvilinear, and so on, may be employed. Underside 18 can include generally semicylindrical mounting channel 19 through which the steering wheel rim or gearshift lever may pass to provide for mounting thereon. The channel 19 can also provide for mounting on handle bars, and so forth. As an alternative, the housing 10 can be made to be cannulated so that the otherwise open semicircular channel 19 passes interiorly through for slipping on a gear shift lever when its knob is removed. Mounted in the cavity 13 is plastic key pad 20 with keys for activation and control of the plow(s) 8, 9. Key pad central element 21 is divided into a two independently actuatable switches 22, 23 to control left and right orientation of the plow 9 or into four independently actuatable switches 24, 25, 26, 27 to control the right wing forward, right wing back, left wing forward and left wing back positions of a V-plow 8. The four-unit central element 21 can be configured so that, for example, its switches 24, 26 effect the control of the straight plow 9. Laterally disposed switch set 28 has two switches 28L, 28R for controlling vertical adjustment of the plow by lowering the plow through the switch 28L and raising it through the switch 28R. Opposing laterally disposed switch set 29 controls the "on-off" function of the plow hydraulics and control through "off" position switch 29F or "on" position switch 29N. Securing member 30 for the system can include strap 31 with hook component 32 to a hook-and-loop fastener such as Velcro with the loop component 33 affixed to the housing 10, say, on its underside 18. The strap 31 can be single or dual member arrangement with fastening contrivance(s) such as buckle(s) 31B on any suitable portion of each member 31L, 31R (FIG. 9); strap looping catch 31C (FIG. 13); hook 32 and loop 33 (FIGS. 8, 10-12); or bolt(s); hitch(es); knot(s); latch(es); magnet(s); snap(s); zipper(s) and so forth and the like. Thus, the system 100 may be attached to the vehicle component of interest with its housing 10 and member 30 while keeping the pad 20 free for operation. Glue may be used. The profile of the system 100 can be kept to a minimum, if not countersunk and set at or below the surface of a component on or in which it is mounted. For instance, when set on the rim or spoke of a steering wheel, a low housing 10 and/or key pad 20 profile and/or countersinking of the unit 100 can be especially beneficial in assisting in providing an unobtrusive control system 100, which can itself further assist in increased safety considerations in addition to those which are generally provided in the first instance by the mounting of the control system at a location near the vehicle operating hand of the operator of the vehicle, which may be, say, on the steering wheel or shift lever. Added bushing 34, which may be considered to be a filler or shim, may be made of a resilient material and employed to take up space around a small diameter member in the cab to which the unit 100 can be attached, if desired or necessary, for example, around a narrow rim or spoke of a steering wheel, or a stick shift lever arm.

Thus, it can be seen that the detachable panel, as well as the strap assembly and the other housing embodiments hereof, make the invention more convenient to hook up plow attachments. The system can be employed on any motor vehicle such as Ford, Dodge, Chevy, Jeep, and so forth, and can be used on construction equipment such as Caterpillar, John Deere, and so forth, as well as on all-terrain vehicles and farm machinery. The soft or semisoft housing can be provided with the semicylindrical or other suitably shaped channel that can fit nearly any tubular or other shape. As well, the underside can be made such that the system can lay flat on or against the dashboard, console, door interior or exterior, or one may simply hold it in his hand if that is his desire. The optional mounting strap may be provided with belt holes and catch, a holeless catching strap, or any suitable fastening arrangement.

The components of the system can be made by known methods. Parts such as transmitters, receivers, wire connectors, power supplies, solenoids switch mechanisms, can be provided in ways known to the skilled artisan or can be commercially obtained.

In wire-connected arrangements, a pig-tail wire-connection from the control system can have a universal J-block that fits the mating end of the plow or other attachment, to include the fitting of standard Western, Meyers, and Power Broom equipment. In cases where the wireless, remote control is employed, the receiver can be mounted at any suitable location, for example, inside the grill or under hood of the vehicle, and employed can be the same or similar type of universal J-block connecter on a two- to three-foot pig-tail to the plow or other attachment.

Accordingly, among advantages of the invention are these:

| | |
|---|---|
| 1) | Generally better safety. |
| 2) | Optionally detachable. |
| 3) | Universal. |
| 4) | Compact. |
| 5) | Operator-friendly. |
| 6) | Wired or wireless. |
| 7) | Convenient. |
| 8) | Saves time and labor. |
| 9) | Increased production. |
| 10) | Durable. |
| 11) | Can be illuminated. |
| 12) | Attractive. |
| 13) | Possible storage in glove box or any small space. |
| 14) | Efficient operation. |
| 15) | Can be highly mobile. |
| 16) | Cost-efficient. |
| 17) | Quiet. |
| 18) | Mounts nearly anywhere. |
| 19) | Simple. |

CONCLUSION

The present invention is thus provided. Various features, parts, subcombinations and combinations can be employed with or without reference to other features, parts, subcombinations or combinations in its practice, and numerous adaptations and modifications can be effected within its spirit, the literal claim scope of which is particularly pointed out as follows:

I claim:

1. An ergonomic plow control system comprising a housing capable of being mounted to a component in a cab of a vehicle; a switch pad having control keys, said pad mounted in the housing such that said keys are readily accessible to an operator of the vehicle while shifting and/or steering during plowing; and a securing member having an attached strap mounting system, wherein the housing, switch pad, and securing member are assembled to be compact such that the same can be stored in a glove box of the vehicle, and wherein the housing and said pad taken together as an assembly is thin in cross section such that when taken from a side view it is at least one of being about one half inch or less; and/or the housing is flexible.

2. The ergonomic plow control system of claim 1, wherein the attached strap mounting system includes a strap system in which is included fastening contrivance(s) to assist in mounting.

3. The ergonomic plow control system of claim 2, wherein the attached strap mounting system has strap(s) with enough weight and flexibility to lie flat when the ergonomic plow control system is not mounted to a component in the cab of the vehicle.

4. The ergonomic plow control system of claim 2, wherein the attached strap mounting system has a two-strap strap arrangement.

5. The ergonomic plow control system of claim 2, wherein the attached strap mounting system has a one-strap strap arrangement.

6. The ergonomic plow control system of claim 1, wherein:

the housing is detachable; and the switch pad includes an arrangement for control of a straight plow and/or a V-plow, which has, mounted in said face:

a central element divided into a plurality of independently actuatable switches for controlling orientation of the plow;

at least one laterally disposed switch set for controlling vertical adjustment of the plow; and another switch set for controlling "on-off" of the plow.

7. The ergonomic plow control system of claim 1, wherein the housing is detachable, and includes mounted therein a switch pad having the control keys to make for an unobtrusive control system with the same including an arrangement for control of a straight plow and/or a V-plow, which has the following features:

a central element divided into a plurality of independently actuatable key pad switches for controlling orientation of the plow;

a first laterally disposed switch set having key pad switches for controlling vertical adjustment of the plow; and a second laterally disposed switch set opposing the first laterally disposed switch set, and having key pad switches for controlling "on-off" of the plow, said system having a minimum profile.

8. The ergonomic plow control system of claim 1, which is wireless and remote.

9. The ergonomic plow control system of claim 2, which is wireless and remote.

10. The ergonomic plow control system of claim 3, which is wireless and remote.

11. The ergonomic plow control system of claim 4, which is wireless and remote.

12. The ergonomic plow control system of claim 5, which is wireless and remote.

13. The ergonomic plow control system of claim 6, which is wireless and remote.

14. The ergonomic plow control system of claim 7, which is wireless and remote.

15. An ergonomic plow control system comprising a housing capable of being mounted to a component in a cab of a vehicle; and a switch pad having control keys, said pad mounted in the housing such that said keys are readily accessible to an operator of the vehicle while shifting and/or steering during plowing, wherein said housing and pad are assembled to be compact and able to be stored in a glove box of the vehicle before being mounted to said component, and wherein the housing is resilient and detachable and includes an underside that has a suitably shaped mounting channel through which a steering wheel rim or gearshift lever can pass within confines of the housing for mounting, and a securing member includes a mounting strap.

16. An ergonomic plow control system comprising a housing capable of being mounted to a component in a cab of a vehicle; and a switch pad having control keys, said pad mounted in the housing such that said keys are readily accessible to an operator of the vehicle while shifting and/or steering during plowing, wherein said housing and pad are assembled to be compact and able to be stored in a glove box of the vehicle before being mounted to said component, and wherein the housing is resilient and detachable and is made to be cannulated to form an interior mounting channel and the securing member so that a gear shift lever with a knob thereof removed can slip through the channel to provide for mounting.

* * * * *